United States Patent [19]

Panetti

[11] 4,288,855

[45] Sep. 8, 1981

[54] DEVICE FOR MEASURING DEFORMATIONS OF THE TRAVEL SURFACE OF THE RAILS OF A RAILWAY

[75] Inventor: Romolo Panetti, Geneva, Switzerland

[73] Assignee: Speno International, S.A., Geneva, Switzerland

[21] Appl. No.: 127,394

[22] Filed: Mar. 5, 1980

[30] Foreign Application Priority Data

Mar. 6, 1979 [CH] Switzerland ..... 2164/79

[51] Int. Cl.[3] ..... G01B 7/28; E01B 27/00

[52] U.S. Cl. ..... 364/561; 364/506; 33/1 Q; 73/146

[58] Field of Search ..... 364/560–563, 364/506; 33/1 Q, 287; 73/7, 8; 324/217

[56] References Cited

U.S. PATENT DOCUMENTS

| | | | |
|---|---|---|---|
| 3,864,039 | 2/1975 | Wilmarth | 33/287 X |
| 4,069,590 | 1/1978 | Effinger | 33/1 Q X |
| 4,137,638 | 2/1979 | Watts | 364/560 X |
| 4,155,176 | 5/1979 | Goel et al. | 33/1 Q X |
| 4,156,971 | 6/1979 | Currie et al. | 364/560 X |
| 4,166,291 | 8/1979 | Shupe | 364/560 |
| 4,173,073 | 11/1979 | Fukazawa et al. | 33/1 Q |
| 4,176,456 | 12/1979 | Beckmann | 33/1 Q |
| 4,181,430 | 1/1980 | Shirota et al. | 33/287 X |

*Primary Examiner*—Edward J. Wise

*Attorney, Agent, or Firm*—Anthony J. Casella

[57] ABSTRACT

A device comprising a traveling chassis (1) equipped with two pickups (5 and 6) arranged opposite a line of rails (2) at a distance apart from each other ($E_1$) which is dependent on the length of the wave of the deformation to be measured.

The traveling chassis (1) is connected to a vehicle which travels over the track.

The two pickups (5 and 6) are connected to an electronic measurement circuit comprising:

a comparator (8) to form the difference of the two measurements effected ($\Delta_1 = {}^hA - {}^hC$) by these pickups, an apparatus (9) for determining the effective wavelength ($\lambda_1 E$) of the deformation.

a processing apparatus (10) adjusted to determine in true magnitude the trough ($H_1$) of this deformation on basis of the difference established ($\Delta_1$), the effective wavelength ($\lambda_1 E$) determined, and the distance ($E_1$) between sensors, a recording device comprising a data condenser (18) and a stylus-type recording tape (11).

7 Claims, 10 Drawing Figures

DEVICE FOR MEASURING DEFORMATIONS OF THE TRAVEL SURFACE OF THE RAILS OF A RAILWAY

The object of the present invention is a device for measuring the deformations of the travel surface of the rails of a railway track and particularly deformations of undulatory nature resulting from stresses from the rolling stock.

The geometrical characteristics of this type of deformation, wavelengths and amplitudes, are not regular and they depend on the mechanical characteristics of the trains, their speeds of travel, the local elasticity of the railway track, and the extent of the resonance phenomena which are produced upon their passage.

These deformations are classified in accordance with their causes and effects in different wavelength ranges extending from that of short waves (OC) to that of long waves (OL), which together cover wavelengths between 3 cm and 3 m on the average.

These deformations become worse with the passage of time and gradually cause greater and greater damage to the rolling stock and the railway track and decrease the comfort of the passengers and of the persons living alongside the track as a result of the vibrations and acoustic waves which they produce.

Before this damage reaches critical proportions, operations for the straightening of the travel surface of the rails are scheduled in the periodic maintenance work on the railway track and are carried out by means of railway vehicles equipped with grinding wheels or abrasive blocks moved along generatrices of said surface until the said deformations are eliminated.

In order to decide the proper time to carry out these operations, it is necessary periodically to check the amplitude of these undulatory deformations in each wavelength range and this inspection must be repeated during and after they are effected in order to determine the state of advance of the straightening work and in order to avoid superfluous passes.

This inspection is effected by means of suitable measurement devices provided on an independent measurement vehicle or a straightening vehicle.

The known measurement devices of the type to which the present invention refers and which are referred to in the preamble of claim 1 are of two types.

Some, of a first type, are equipped with a distance detector arranged between the two rollers of the traveling chassis so as to measure the sag in the travel surface of the rail between the two zones of contact of these rollers. In this first type of device, the distance between the rollers is selected as a function of the wave range of the deformation to be measured in such a manner that the sag thus measured corresponds approximately to the trough of said deformation. Several traveling chassis with different distance between rollers can follow each other or be contained within one and the same device of this first type in order simultaneously to measure deformation troughs of different wave ranges.

The others, of a second type, are equipped with at least one group of three distance detectors spaced apart from each other and arranged between the two rollers of the traveling chassis so as to measure, by means of the intermediate detector, the sag present in the travel surface of the rail between the two zones detected by the two end detectors. In this second type of measurement device, it is the distance between the two end detectors which is selected as a function of the wave range of the deformation to be measured, independently of the distance between the two rollers of the traveling chassis which distance can be selected on basis of other criteria. Several groups of detectors can be mounted on the same traveling chassis of this second type of device with different distances between end detectors or with different distance ratios between the intermediate detector and the end detectors in each group, in order simultaneously to measure the troughs of several deformations of different wave ranges.

These two types of known measurement devices raise problems.

Those of the first type do not make it possible to measure with sufficient precision short wave deformations, due to the fact that the rollers of the traveling chassis cannot be brought sufficiently close together, because of their size, to obtain a suitable ratio between their distance apart and the greatly reduced length of the waves (on the order of 3 to 15 cm) of these deformations, which include in particular those due to the undulatory wear to which railway departments attach a good deal of importance. Furthermore, with these measuring devices of the first type, the measurement is influenced by the vibrations of the traveling chassis such as those which may be caused, for instance, by ovalness of the rollers or else by the inherent elasticity of the said chassis, since this measurement is effected by direct reference to its position in space.

The measurement devices of the second aforementioned type provide a solution for these problems, due to the fact that the distance detectors, of smaller size than the rollers of the traveling chassis, can be brought sufficiently close together to measure the short waves under better conditions and due to the fact that the measurement is less dependent on the position occupied in space by the traveling chassis since it refers to the relative position of the two zones of the travel surface of the rails which are detected by the two end detectors. On the other hand, these devices require the use of a large number of detectors since three are necessary for the measurement of each wave range, and this multiplicity of sensitive apparatus increases, at least in equal proportions, the need for adjustment and maintenance as well as the risks of breakdown, and this whatever the nature of the detectors employed, whether electromechanical pickups in contact with the rail or contact-free electronic pickups.

Furthermore, and in particular, these devices of the first and second type do not make it possible to obtain the trough of the deformation in its true value since the value of the trough measured depends essentially on the length of the wave of the deformation, which varies in each wave range, as will be shown further below.

The device in accordance with the invention, as defined in claim 1, proposes a solution for these problems in the sense that the value used to determine the trough $H_1$ of the deformation detected, that is to say the difference $\Delta_1$ between the two measured distances $h_A$ and $h_C$, is not influenced by the variations of these two distances caused by the vibrations of the traveling chassis, and by the fact that two distances between detectors are sufficient to permit the determination of this value. Finally the trough $H_1$ of the deformation is thus always determined in true size, regardless of the variations of the effective wavelength $\lambda_1 E$, due to the treatment of the difference $\Delta_1$ by a transfer coefficient $T_1$ which takes these variations into account.

The accompanying drawing illustrates one particular point of the technique which has been set forth and shows by way of example, three embodiments of the object of the invention.

Figure 1:
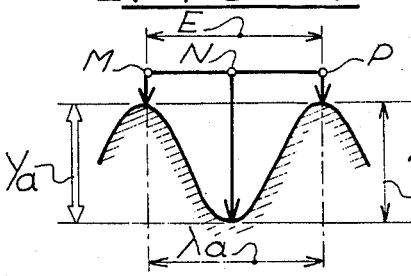
FIGS. 1 and 2 are geometrical diagrams referring to the known technique.
Figure 2:
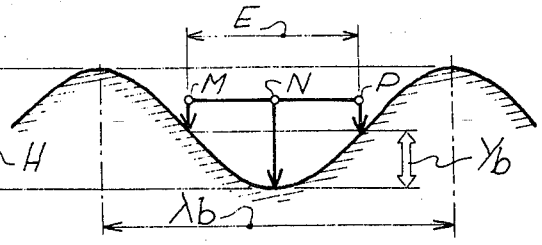

FIGS. 1 and 2 show diagrammatically, greatly enlarged, two deformations of undulatory type of the same trough H but of different wavelength $\lambda_a<\lambda_b$ detected by one and the same measurement device having three points M, N and P, of the second known type referred to above, forming a reference base MP of selected length E contained within a wavelength range in which $\lambda_a$ and $\lambda_b$ are included.

The measured trough values $Y_a$ and $Y_b$ are not equal, and it is seen that for a larger wavelength ($\lambda_b>\lambda_a$), the measured trough value is smaller ($Y_b<Y_a$).

The measured trough values $Y_a$ and $Y_b$ therefore do not necessarily represent the trough H in true size but, on the contrary, variable values dependent on the wavelength of the deformation, which values cannot be used as is but must still be interpreted. This means that in the final analysis one cannot speak of "measured" deformations but rather of deformations which are "estimated" by means of these devices.

Figure 3:
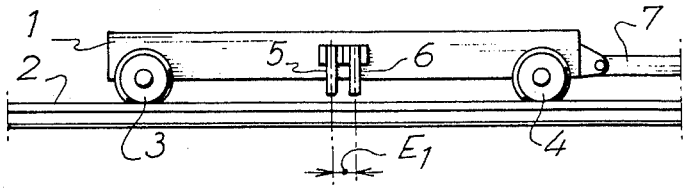
FIG. 3 is a diagrammatic view in elevation of the chassis of the first embodiment.
Figure 4:
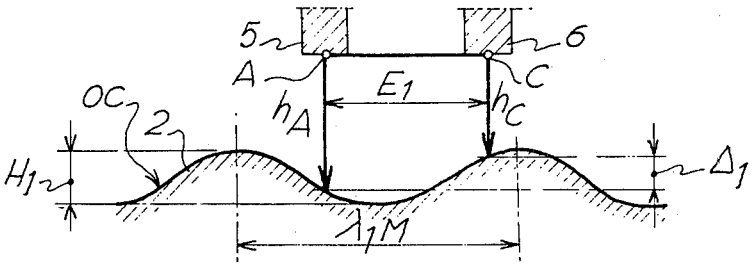
FIG. 4 is a geometrical diagram relating thereto.
Figure 5:
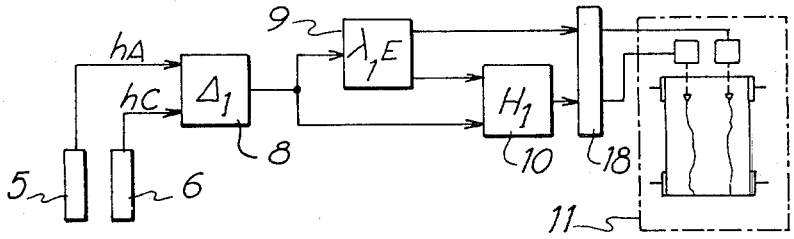
FIG. 5 is a block diagram of its electronic measurement circuit.

The first embodiment of the device shown, FIGS. 3 and 5, is intended for the measurement of the undulatory deformations of the travel surface of the rails of a railway track whose wavelength is contained within the same wave range $\lambda_1$, for instance within a range of short waves OC which is between 3 and 15 cm, and the shape of which is shown diagrammatically on a greatly enlarged scale in FIG. 4.

This device comprises a traveling chassis 1 resting on each of the two lines of rails 2 of a railway track via two guide rollers 3 and 4. This chassis 1 is equipped with two contact-less electronic pickups 5 and 6, for instance of eddy-current type, arranged between the two rollers opposite a generatrix of the line of rails 2 and at a distance $E_1$ from each other which is less than the shortest wavelength $\lambda_1 M$ of the deformations contained within the selected wave range $\lambda_1$, as shown in FIG. 4, in accordance with a first relationship $E_1<\Delta_1 M$. This traveling chassis 1 is connected by an articulated shaft 7 to a vehicle intended to travel over the track to be measured, not shown in the drawing.

The two pickups 5 and 6 are adjusted to deliver electric signals which are representative of the distances $h_A$ and $h_C$ between two fictitious points A and C of the traveling chassis 1 and the generatrix in question of the line of rails 2, the segment $\overline{AC}$ constituting a reference base parallel to said generatrix (FIG. 4). These two pickups are connected to an electronic measurement circuit which is arranged preferably in the control cab of the pulling vehicle and the block diagram of which is shown in FIG. 5.

This electronic circuit is adapted to act in accordance with a method of determination of the value of the trough $H_1$ of the aforementioned wavelength deformation using as starting value the difference $\Delta_1$ of the two distance values $h_A$ and $h_C$.

This difference value $\Delta_1$ is related to the value of the trough $H_1$ by the relationship:

$$\Delta_1=\pm H_1 \sin \pi(E_1/\lambda_1 E),$$

this relationship being established on basis of the measured input value $\lambda_1$ and the ratio $E_1/\lambda_1 E$ of the distance between feelers $E_1$ to the effective wavelength $\lambda_1 E$ of the detected deformation contained within the range of selected waves, assumed to be of sinusoidal shape.

In order to avoid a passage to zero of the transfer function T, this ratio $E_1/\lambda_1 E$ is selected with respect to the relationship:

$$0<\pi(E_1/\lambda_1 E)<\pi$$

and the recommended values of this ratio, which are most favorable but not limitative are between 1/6 and 5/6:

$$1/6<(E_1/\lambda_1 E)<5/6$$

This method of determination of the trough $H_1$ offers the aforementioned advantage of making the measurement independent of the vibrations of the traveling chassis 1, due to the fact that the value of the difference $\Delta_1$ used is not affected by vertical translation of the traveling chassis 1 and is affected by a rotation of the chassis only in a ratio which is less than the permitted tolerances.

As a matter of fact, under the effect of a vertical translation Y of the traveling chassis 1, the value of this difference is $$\Delta_1=(h_{A-y})-(h_{C-y})$$

namely $\Delta_1=h_A-h_C$, value unchanged.

Under the effect of a rotation, for instance caused by a lack of true of 0.1 mm on the part of the rollers 3 and 4, they being spaced 2000 mm apart, the maximum inclination of the reference base $\overline{AC}$ is 0.1/2000 and the error in the measurement is accordingly negligible.

In order to deliver an output signal which is representative of the trough $H_1$ of the deformation in accordance with the method indicated above, the electronic circuit shown diagrammatically in FIG. 5 comprises, connected to the pickups 5 and 6:

a comparator 8 which delivers an output signal representative of the difference between the two distances measured by the pickups 6 and 6, namely $\Delta_1=h_A-h_C$.

an apparatus 9 for determining the effective average length $\lambda_1 E$ of the wave of the deformation detected, giving off an output signal representative of said value.

an apparatus 10 for the processing of the signals $\Delta_1$ and $\lambda_1 E$ which is connected to the outputs of the comparator 8 and of the determination apparatus 9 and delivers an output signal representative of the trough $H_1$ of said deformation by action on the above difference $\Delta_1$ in accordance with a transfer coefficient $T_1$ established on basis of the ratio $E_1/\lambda_1 E$ between the distance $E_1$ between the two pickups 5 and 6 and the effective average length of the wave of the detected deformation $\lambda_1E$.

For the purpose of further analysis, the output signals of the determination apparatus 9 and of the processing apparatus 10, which are representative of said effective average wavelength $\lambda_1E$ and of the trough $H_1$, are sent to a recording device 11 which, in this case, is a tape with drawing styluses but which can also consist of a magnetic tape, supplemented or not by a coder in order to convert these analog signals into digital values. In order to condense the information so as to give it form which can be employed directly on the paper recording tape, a data condenser 10 is interposed in the processing circuit at the entrance to the recording device 11. This condenser circuit 18 may, for instance, be of the type described in Swiss Pat. No. 588374 comprising an operational rectifier and a device for determining the current continuous average of the speed controlled by the speed V of the measurement vehicle.

The apparatus 9 for determining the effective average wavelength $\lambda_1E$ of the deformation detected, which has not been defined concretely above, may consist either of an adder-subtractor of the changes of sign of the difference $\Delta_1$ of the distance values $h_A$ and $h_C$ measured by the pickups 5 and 6, or of an analyzer of the frequency spectrum of said deformation, or else a combination of these two means.

The processing apparatus 10 which delivers the output signal representative of the trough $H_1$ may consist either of a computer programmed to deliver the said signal as a function of the transfer coefficient $T_1$ or of a frequency filter adjusted in accordance with a coefficient $1/T_1$ which is the reciprocal of the said transfer coefficient.

Figure 6:
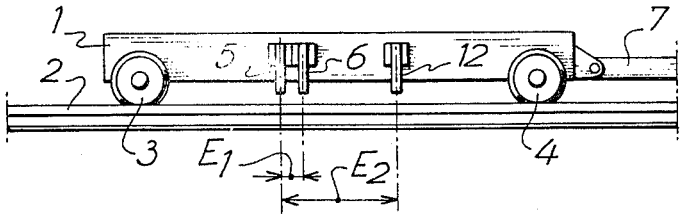
FIG. 6 is a diagrammatic elevation of the chassis of the second embodiment.
Figure 8:
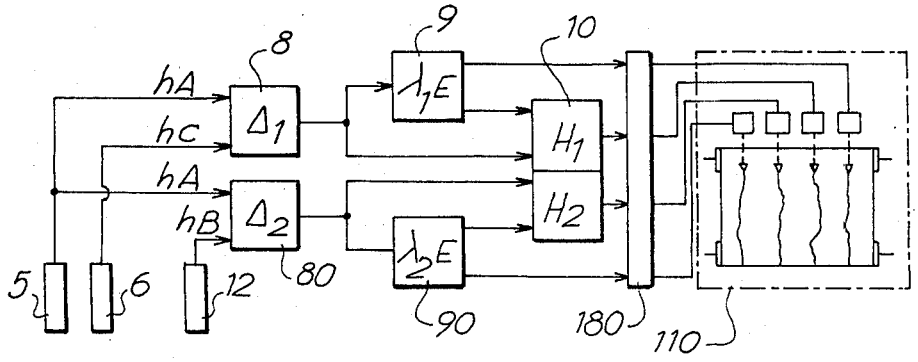
FIG. 8 is a block diagram of its electronic measurement circuit.

The second embodiment of the measurement device, shown in FIGS. 6 and 8, is intended for the simultaneous measurement of deformations whose wavelength is included within two different wave ranges $\lambda_1$ and $\lambda_2$, such as for instance the short waves already mentioned contained between 3 and 15 cm and the medium waves contained between 15 and 90 cm for instance.

Figure 7:
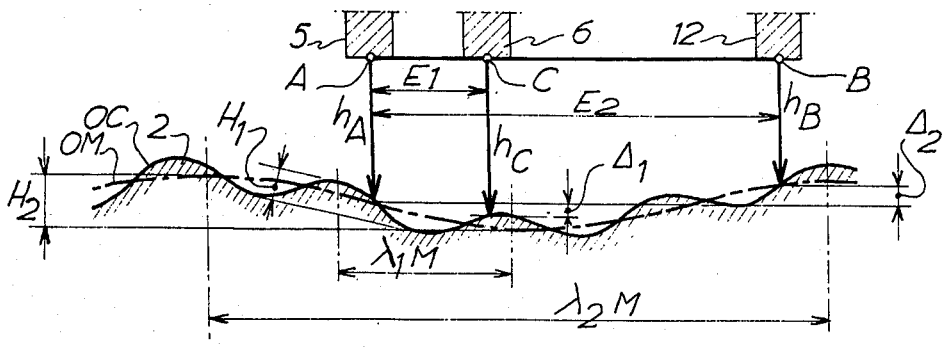
FIG. 7 is a geometrical diagram relating thereto.

FIG. 7 shows diagrammatically greatly enlarged, the shape of a generatrix of the line of rails 2 having short wave deformations OC supported by medium wave deformations OM.

It is obvious that in this case, after the grinding of the short wave deformations OC, there will remain the medium wave deformations OM. It is therefore of interest upon one and the same measurement passage to check both of these two classes of deformations.

The traveling chassis 1 shown in FIG. 6 is provided for this purpose with the same elements, rollers 3 and 4 and pickups 5 and 6, as the one already described for the measurement of the same short wave deformations OC, the pickups 5 and 6 being at the same distance apart $E_1<\lambda_1M$, with furthermore a third contact-free pickup 12, of the same kind, forming with the pickup 5 a second set of two pickups for the measurement of the aforementioned average waves OM, the said pickup 5 thus belonging to both sets of pickups equipping this traveling chassis. This additional pickup 12 is arranged in the alignment of the two other pickups 5 and 6, opposite the same generatrix of the line of rails 2, at a distance $E_2$ from the pickup 5, which is less than the shortest wavelength $\lambda_2M$ of the deformations contained between the second selected wave range $\lambda_2$ of the medium waves OM, in accordance with the relationship $E_2<\lambda_2M$ corresponding to what has been stated above. This pickup 12 is also adjusted to deliver electric signals which are representative of the distances $h_B$ separating a third fictitious point B of the traveling chassis 1 from the generatrix in question of the line of rails 2, the segment $\overline{AB}$ containing the point C which constitutes the reference base of this second embodiment (FIG. 7).

These three sensors 5, 6 and 12 are connected to an electronic measurement circuit, represented diagrammatically in FIG. 8, comprising the same components, comparator 8, determination apparatus 9 and processing apparatus 10, as already described for the determination of the characteristics $\Delta_1$, $\lambda_1M$ and $H_1$ of the deformations of the range $\lambda_1$ of the short waves based on the distance signals $h_A$ and $h_C$ coming from the two pickups 5 and 6 of the first set to which these components are connected. This circuit furthermore comprises a second measurement chain formed of a second comparator 80 and a second determination apparatus 90, which are connected to the second set of sensors 5 and 12 and to the processing apparatus 10 for the determination of the characteristics of the deformations of the second selected range $\lambda_2$ of medium waves, the trough $H_2$ of the said deformations and their effective average length $\lambda_2E$, based on the difference $\lambda_2$ of the distance values $h_A$ and $h_B$ measured by these two pickups 5 and 12. In this measurement circuit, the processing apparatus 10 comprises a second stage which is adjusted in accordance with a transfer coefficient $T_2$ established on basis of the ratio $E_2/\lambda_2E$ in accordance with the same method as that described for the first selected wave range $\lambda_1$.

For further analysis, the output signals of this measurement circuit are in this case also shown directed to a recording device 110 via a data condenser 180.

Of course, in accordance with the same principle of embodiment, it is possible to equip a traveling chassis with several sets of two pickups, independent or combined as in this second embodiment, in order simultaneously to measure more than two wave ranges of deformation.

Although the devices shown in FIGS. 3 and 6 are suitable for the measurement of the deformations of the travel surface of the rails in a vertical plane, it is obvious that the invention is applicable to all devices developed in the same manner but suitable for the measurement of deformations in other planes, oblique and/or horizontal, distributed around the head of the rails on the fillet or the inner flank.

Figure 9:
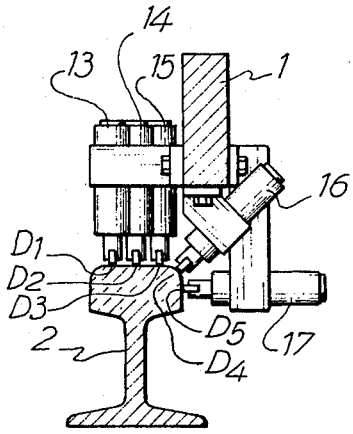
FIGS. 9 and 10 are a front sectional view and a top view respectively of a detail of the third embodiment.
Figure 10:
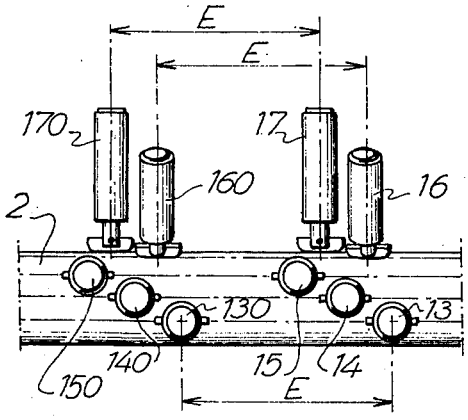

In the development of a program for straightening the travel surfaces of the rails of a railway track by grinding, it is useful to know the distribution of the deformation on the transverse profile of the rails since this distribution is not uniform and furthermore affects the travel surface, the fillet and the inner flank of the rail head, depending on the course of the track, alignment, curve, bank, as well as the load per axle of the trains. In a third embodiment of the measurement device intended for this purpose, a detail of which is shown in FIGS. 9 and 10, several sets of two pickups are arranged on the same traveling chassis, opposite a corresponding number of generatrices of the line of rails distributed over the transverse profile of the rail head.

In this third embodiment, five sets of two pickups 13, 130, 14, 140, 15, 150, 16, 160 and 17, 170 are fastened to the traveling chassis 1 opposite five generatrices $D_1$, $D_2$, $D_3$, $D_4$ and $D_5$ respectively of the head of the rail 2. In FIG. 10, in which only these pickups and the rail 2 are shown, it is seen that the two pickups of each set are arranged at the same distance E from each other, this distance E being determined, as previously, as a function of the selected range of wavelengths. These pickups, of inductive or capacitative type, for instance, have a contact feeler formed of a small tab of steel of high resistance to wear which is pivoted to the end of their measurement rods. The five sets of pickups can be staggered in the longitudinal direction of the rail 2 in order to solve the problem of the space taken up by them.

The group of pickups of this third embodiment is connected to an electronic measurement circuit, not shown, which for each of their five sets has a measurement chain consisting of the same components as the circuit shown in FIG. 2. The output signals of this measurement circuit are directed to a multi-track graphical or magnetic recording device in order to serve as base for the determination of the envelope of the transverse profile of the travel surface of the head of the rail 2 defined by the position in space of the five generatrices detected, for instance by means of an analyzer programmed for this determination.

It goes without saying that in this third embodiment several sets of two pickups can also be installed on each of the generatrices of the rail when several deformations of different wave ranges are to be measured. Likewise, the number of generatrices used may be other than five, depending on the degree of precision desired for the establishing of the envelope of the head of the rail.

Finally the contact-free pickups of the first two embodiments, the use of which is advantageous for rapid measurement runs, could be replaced by pickups in contact with the surface of the rail, of the type of those used in the third embodiment which has just been described, when the measurement runs can be effected at low speed, in the same way as the contact-less detectors can be used in the third embodiment.

Of course the invention is applicable also in any other system having a measurement base equivalent to the two point base $\overline{AC}$ mentioned, for instance in a strongly asymmetric three-point measurement system in which the measurement effected in accordance with the invention by means of the two points closest to this base is not affected by the third point, within the limits of the tolerances prescribed.

What is claimed is:

1. Device for measuring deformations of the travel surface of the rails of a railway track of at least one wavelength contained within a selected wavelength range ($\lambda_1$), comprising a traveling chassis (1) resting on at least one line of rails by two spaced guide rollers (3 and 4), the chassis being connected to a vehicle traveling over the track at a given speed (V) and being equipped with at least one group of measurement pickups giving off electric signals representing distances between a linear reference base defined by the position in space, of the said rolling chassis and the line of rails moved over, and also comprising a circuit for the processing of these signals intended to determine the value of the trough ($H_1$) of the said wavelength deformation, characterized by the fact that the group of measurement pickups comprises at least one first set of two pickups (5 and 6) arranged opposite a generatrix of the line of rails moved over at a distance from each other ($E_1$) less than the shortest wavelength ($\lambda_1 M$) of the selected wavelenth range ($\lambda_1$) and supplying two electric signals representing two distances respectively ($h_A$ and $h_C$) between two points (A and C) of the base reference line ($\overline{AC}$) of the base reference line ($\overline{AC}$) and the said generatrix, and by the fact that these two pickups are connected to an electronic measurement circuit comprising a comparator (8) giving off an output signal representative of the difference ($\Delta_1 = h_A - h_C$) of the two said distances, an apparatus (9) for determining the effective average length ($\lambda_1 E$) of the wave of the deformation detected, giving off an output signal representing said magnitude, and an apparatus (10) for the processing of these signals ($\Delta_1$ and $\lambda_1 E$) connected to the outputs of the comparator (8) and of the determination apparatus (9) and delivering an electric output signal representative of the trough ($H_1$) of the said deformation by processing of the said difference ($\Delta_1$) in accordance with a transfer coefficient ($T_1$) established on basis of the ratio ($E_1/\lambda_1 E$) between the distance ($E_1$) between the two pickups (5 and 6) and the determined effective average length ($\lambda_1 E$) of the wave of the detected deformation.

2. Measurement device according to claim 1, characterized by the fact that the apparatus (9) for determination of the effective average length of the wave of the deformation detected ($\lambda_1 E$), is formed of an adder-subtractor of the changes of sign of the difference ($\Delta_1$) of the two distances ($h_A$ and $h_C$) measured by the pickups (4 and 5) of the traveling chassis (1).

3. Measurement device according to claim 1, characterized by the fact that the apparatus (9) for determining the effective length of the wave of the deformation detected ($\lambda_1 E$) is formed of a frequency spectrum analyzer.

4. Measurement device according to claim 1, characterized by the fact that the processing apparatus (10) consists of a computer.

5. Measurement device according to claim 1, characterized by the fact that the processing apparatus (10) consists of a frequency filter which is adjusted in accordance with a coefficient ($1/T_1$) which is the reciprocal of the transfer coefficient ($T_1$).

6. Measurement device according to claim 1, characterized by the fact that it comprises at least one second set of two pickups which is formed of one (5) of the two pickups of the first set (5 and 6) and of an additional pickup (12), which are arranged on the traveling frame (1) in the alignment of the two pickups of the first set and at a distance ($E_2$) from each other less than the shortest wavelength ($\lambda_2 M$) of the deformations contained in a second selected range of waves ($\lambda_2$), and by the fact that the electronic measurement circuit comprises at least one second comparator (80) and a second determination apparatus (90) which are connected to the two pickups of the second set (5 and 12) and to the processing apparatus (10), the latter having a second stage adjusted in accordance with a transfer coefficient ($T_2$) established on basis of the ratio ($E_2/\lambda_2 E$) of the distance ($E_2$) between the two pickups (5 and 12) of the second set to the effective average length ($\lambda_2 E$) of the wavelength deformation included in the second wave range selected ($\lambda_2$) for the determination ($H_2$) of the trough of this deformation.

7. Measurement device according to claim 1, characterized by the fact that it comprises a plurality of sets of pickups arranged on the traveling chassis (1) opposite a corresponding number of generatrices ($D_1$, $D_2$, $D_3$, $D_4$, $D_5$) distributed over the transverse profile of the head of the line of rails, these sets of pickups being intended to be connected to a processing and analysis circuit programmed to determine the envelope of the said transverse profile defined by the position in space of the said generatrices.

* * * * *

UNITED STATES PATENT AND TRADEMARK OFFICE

CERTIFICATE OF CORRECTION

PATENT NO. : 4,288,855

DATED : September 8, 1981

INVENTOR(S) : Romolo Panetti

It is certified that error appears in the above—identified patent and that said Letters Patent is hereby corrected as shown below:

In the title, after the word "RAILWAY" insert -- TRACK --.

Signed and Sealed this

*Seventeenth* Day of *November 1981*

[SEAL]

*Attest:*

GERALD J. MOSSINGHOFF

*Attesting Officer*

*Commissioner of Patents and Trademarks*